US011193734B2

(12) United States Patent
Xiong et al.

(10) Patent No.: US 11,193,734 B2
(45) Date of Patent: Dec. 7, 2021

(54) FAST OVERTURNING BRACKET FOR A GUN SIGHT

(71) Applicant: WUHAN GOLDEN MINNA PHOTOELECTRIC SCI & TECH CO., LTD, Wuhan (CN)

(72) Inventors: Min Xiong, Wuhan (CN); Fan Hu, Wuhan (CN); Haibei Xiong, Wuhan (CN); Xiaoming Peng, Wuhan (CN)

(73) Assignee: WUHAN GOLDEN MINNA PHOTOELECTRIC SCI & TECH CO., LTD, Wuhan (CN)

( * ) Notice: Subject to any disclaimer, the term of this patent is extended or adjusted under 35 U.S.C. 154(b) by 0 days.

(21) Appl. No.: 16/305,324

(22) PCT Filed: Mar. 8, 2018

(86) PCT No.: PCT/CN2018/078368

§ 371 (c)(1),
(2) Date: Nov. 28, 2018

(87) PCT Pub. No.: WO2019/095589

PCT Pub. Date: May 23, 2019

(65) Prior Publication Data

US 2021/0223002 A1 Jul. 22, 2021

(30) Foreign Application Priority Data

Nov. 17, 2017 (CN) ..... 201711146177.2

(51) Int. Cl.
*F41G 11/00* (2006.01)
*F41G 1/26* (2006.01)

(52) U.S. Cl.
CPC ..... *F41G 11/003* (2013.01); *F41G 1/26* (2013.01)

(58) Field of Classification Search
CPC ..... F41G 11/003; F41G 1/16; F41G 1/26
USPC ..... 42/124–126
See application file for complete search history.

(56) References Cited

U.S. PATENT DOCUMENTS 9,217,621 B2 * 12/2015 He ..... F41G 11/003

OTHER PUBLICATIONS

Search report of PCT/CN2018/078368.
Writing opinion of PCT/CN2018/078368.

* cited by examiner

*Primary Examiner* — Reginald S Tillman, Jr.
(74) *Attorney, Agent, or Firm* — Dragon Sun Law Firm, PC; Jinggao Li, Esq.

(57) ABSTRACT

The present disclosure relates to the technical field of gun sight accessories, and in particular to a fast overturning bracket for a gun sight. The fast overturning bracket includes a bracket body, wherein the bracket body is composed of a main body and a pressing plate, and the pressing plate is fixed at a right side edge of the main body through a pressing plate bolt. The fast overturning bracket further includes an overturning rack. A connecting block perpendicular to the overturning rack is arranged at a bottom of a left side of the overturning rack; a groove is formed in a left side edge of the main body; the connecting block is embedded into the groove; and the connecting block is connected with the main body through a locating mechanism.

9 Claims, 13 Drawing Sheets

FAST OVERTURNING BRACKET FOR A GUN SIGHT

CROSS-REFERENCE TO RELATED PATENT APPLICATION

This application is a national stage application of International Patent Application PCT/CN2018/078368, filed Mar. 8, 2018, which itself claims the priority to Chinese Patent Application No. 201721561376.5, filed Nov. 17, 2017 in the National Intellectual Property Administration, also known as the Chinese Patent Office, both of which are expressly incorporated by reference herein in their entirety.

Some references, which may include patents, patent applications, and various publications, are cited and discussed in the description of the present disclosure. The citation and/or discussion of such references is provided merely to clarify the description of the present disclosure and is not an admission that any such reference is "prior art" to the invention described herein. All references cited and discussed in this specification are incorporated herein by reference in their entireties and to the same extent as if each reference was individually incorporated by reference.

TECHNICAL FIELD

The present disclosure relates to the technical field of gun sight accessories, and in particular to a fast overturning bracket for a gun sight.

BACKGROUND ART

It is well-known that during use of a gun, a gun sight is suitable for use to increase a visual length when a target is far, but is ineffective at close range as it is difficult to capture the target. Likewise, other accessories on the gun, such as a night-vision device, have similar problems. The night-vision device is suitable for use at night or in dim light, and is ineffective in use at daytime.

While during use generally, when the gun sight or other accessories are mounted, a fixture is mounted on the gun firstly, then the gun sight is put on the fixture and locked by a bolt locking fixture, and it is difficult to disassemble the gun sight in a short time when close-range shooting is required. Thus, the gun simply has a single long-range shooting function, can't be fast adjusted according to use requirements, and is very inconvenient in use.

Therefore, an unaddressed need exists in the art to address the aforementioned deficiencies and inadequacies.

SUMMARY OF THE PRESENT DISCLOSURE

The purpose of the present disclosure is to provide a fast overturning bracket for a gun sight, which can achieve fast adjustment on and intermittent use of the gun sight, to solve the problems in the prior art.

In order to achieve the purpose, the present disclosure adopts the following technical scheme.

A fast overturning bracket for a gun sight comprises: a bracket body, wherein the bracket body is composed of a main body and a pressing plate, and the pressing plate is fixed at a right side edge of the main body through a pressing plate bolt; the fast overturning bracket further comprises an overturning rack; a connecting block perpendicular to the overturning rack is arranged at a bottom of a left side of the overturning rack; a groove is formed in a left side edge of the bracket body; the connecting block is embedded into the groove; and the connecting block is connected with the main body through a locating mechanism.

Further, the locating mechanism comprises a locating screw, a locating bolt and four locating pins, wherein the locating screw is in threaded connection with the locating bolt, and the locating pins are fixed at a front end face of the main body.

Further, four locating grooves are uniformly formed in a screw cap of the locating screw and correspond to the four locating pins in position, and a middle portion of the locating screw is square.

Further, the locating bolt comprises a first bolt column and a second bolt column, and the first bolt column and the locating screw have identical diameters.

Further, a first through hole, a second through hole and a third through hole are formed in the main body; a fourth through hole is formed in the connecting block; the first through hole, the second through hole and the fourth through hole have diameters identical to the diameter of the locating screw; and the third through hole and the second bolt column have identical diameters.

Further, the third through hole and a bottom surface of the second bolt column form an elastic restoring chamber, and a spring I is arranged in the elastic restoring chamber.

Further, a first fixing groove and a second fixing groove are formed in an outer surface of the connecting block respectively, and the first fixing groove and the second fixing groove are located on an inner side and a bottom surface of the connecting block, respectively.

Further, two fixing holes are formed in a bottom of the groove, and a spring II inside and a ball outside are arranged in each of the two fixing holes.

Preferably, a plate surface of the overturning rack is a straight plate, and a cylinder rack for fixing the gun sight is arranged on the overturning rack.

Preferably, the plate surface of the overturning rack is an arc-shaped plate, a semicircular rack for fixing the gun sight is arranged on the overturning rack, and the plate surface of the semicircular rack is symmetrical to the plate surface of the overturning rack.

The present disclosure has the following beneficial effects:

1. compared with the prior art, the fast overturning bracket for the gun sight is designed according to the principles that the bracket body is fixed to a gun, the gun sight is locked onto the overturning rack, and the bracket body is connected with the overturning rack through the locating mechanism, so that the overturning rack can rotate on the bracket body; and thus, the gun sight can be overturned fast on the gun, and the purpose that the gun sight is used intermittently can be achieved;

2. the connecting block is locked by the locating mechanism and a ball and spring mechanism, so that the gun sight does not rotate when the gun sight is in use or after the gun sight is overturned; double-lock locating is conducted precisely and firmly; and button start operation is convenient and fast to conduct;

3. the plate surface of the overturning rack is the straight plate, and the overturning rack can be fixedly provided with devices such as the night-vision device, so that fast overturning and intermittent use of the different gun accessories are achieved; and the fast overturning bracket is wide in application scope.

BRIEF DESCRIPTION OF THE DRAWINGS

The accompanying drawings illustrate one or more embodiments of the present invention and, together with the written description, serve to explain the principles of the invention. Wherever possible, the same reference numbers are used throughout the drawings to refer to the same or like elements of an embodiment.

DETAILED DESCRIPTION OF THE PRESENT DISCLOSURE

Figure 1:
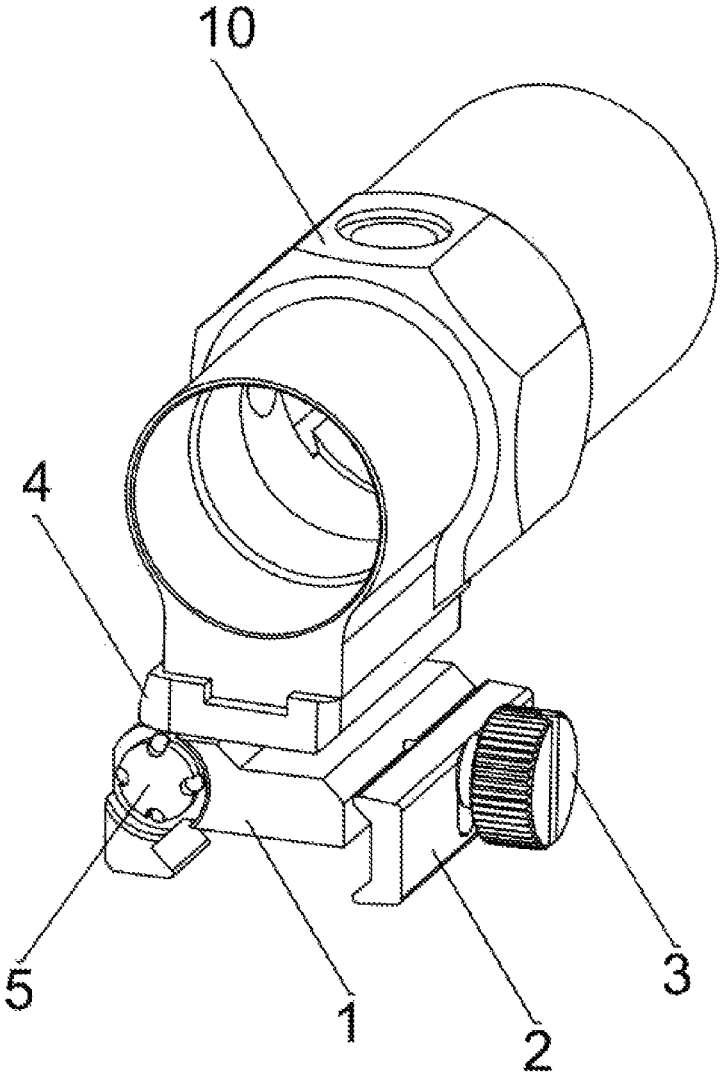
FIG. 1 is a perspective view of a gun sight of Example 1 in use.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure is thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It is appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

It is understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It is understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

It is understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It are also appreciated by those of skill in the art that references to a structure or feature that is disposed "adjacent" to another feature may have portions that overlap or underlie the adjacent feature.

The terminology used herein is for the purpose of describing particular embodiments only and is not intended to be limiting of the invention. As used herein, the singular forms "a," "an," and "the" are intended to include the plural forms as well, unless the context clearly indicates otherwise. It is further understood that the terms "comprises" and/or "comprising," or "includes" and/or "including" or "has" and/or "having" when used in this specification specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the figures. It is understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It is further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around," "about," "substantially" or "approximately" shall generally mean within 20 percent, preferably within 10 percent, and more preferably within 5 percent of a given value or range. Numerical quantities given herein are approximate, meaning that the terms "around," "about," "substantially" or "approximately" can be inferred if not expressly stated.

As used herein, the terms "comprise" or "comprising," "include" or "including," "carry" or "carrying," "has/have" or "having," "contain" or "containing," "involve" or "involving" and the like are to be understood to be open-ended, i.e., to mean including but not limited to.

As used herein, the phrase "at least one of A, B, and C" should be construed to mean a logical (A or B or C), using a non-exclusive logical OR. It should be understood that one or more steps within a method may be executed in different order (or concurrently) without altering the principles of the invention.

Embodiments of the invention are illustrated in detail hereinafter with reference to accompanying drawings. It should be understood that specific embodiments described herein are merely intended to explain the invention, but not intended to limit the invention. In accordance with the purposes of this invention, as embodied and broadly described herein, this invention, in certain aspects, relates to a fast overturning bracket for a gun sight.

The present disclosure will be described below in details in combination with preferred examples and accompanying drawings for further understanding of purposes, features and functions of the present disclosure by examiners.

Example 1

Figure 2:
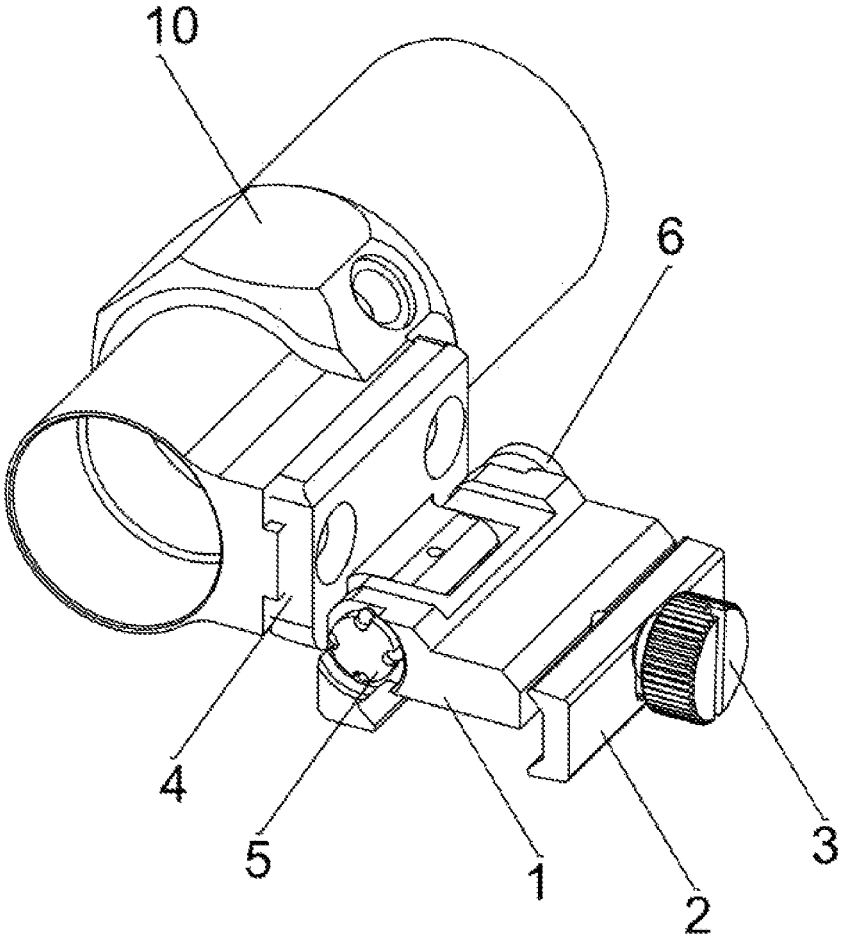
FIG. 2 is a perspective view of the overturned gun sight of Example 1.
Figure 3:
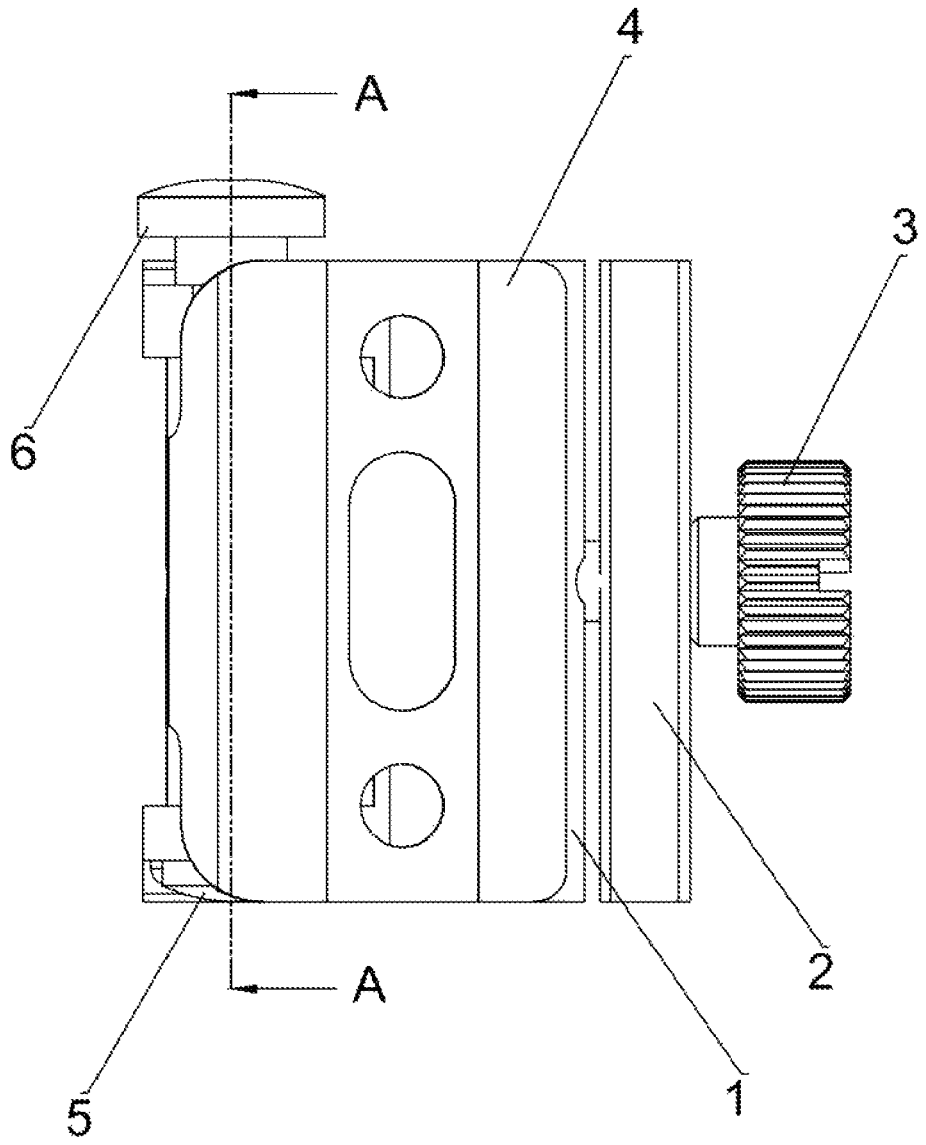
FIG. 3 is an assembling top view of a bracket body, an overturning rack and a locating mechanism of Example 1.
Figure 4:
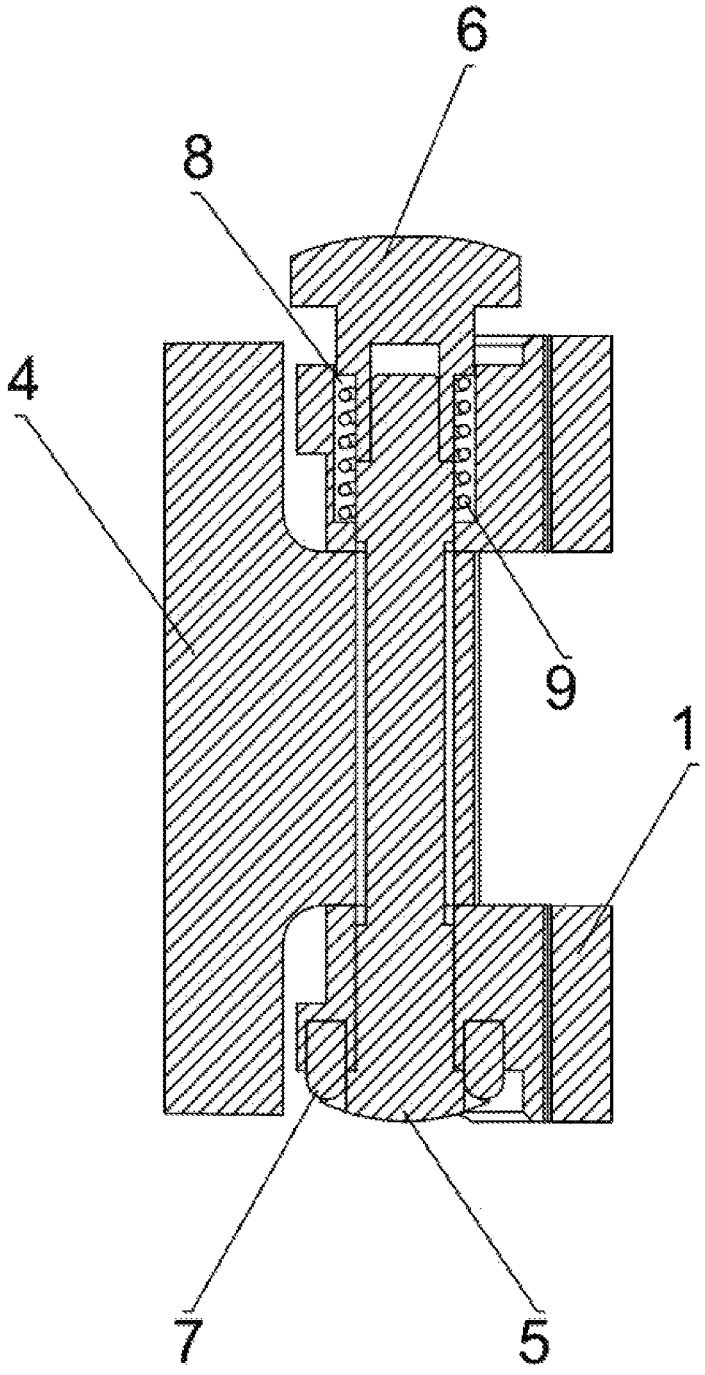
FIG. 4 is a section of an A-A portion in FIG. 3.
Figure 5:
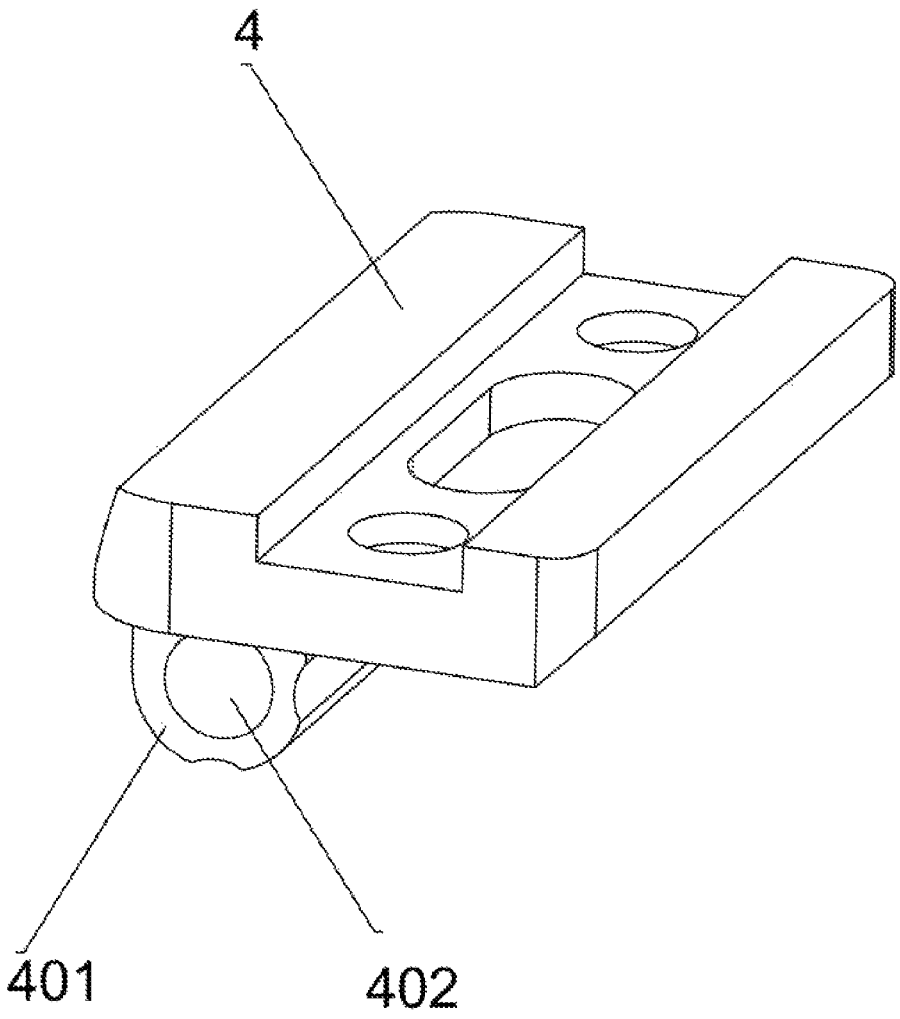
FIG. 5 is a perspective view of the overturning rack of Example 1.
Figure 6:
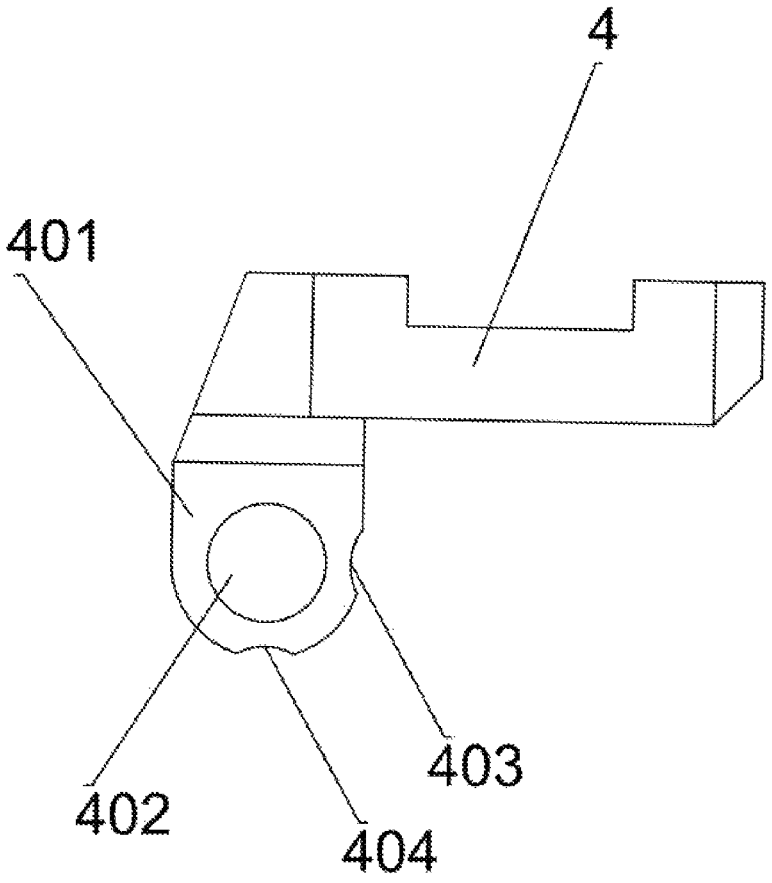
FIG. 6 is a front view of the overturning rack of Example 1.
Figure 7:
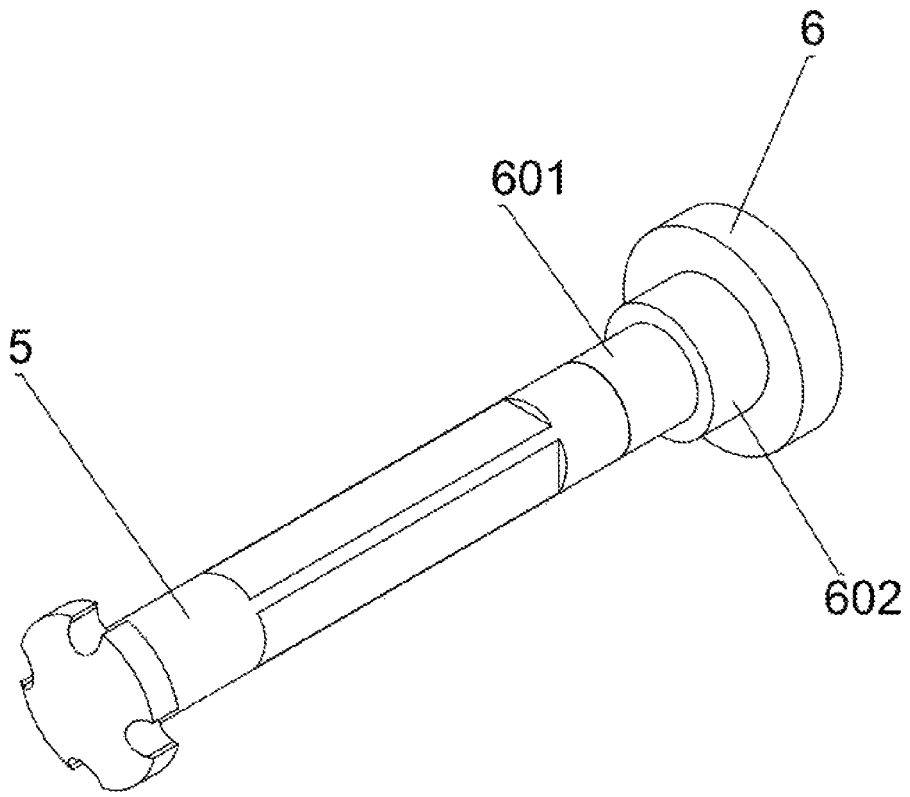
FIG. 7 is an assembling perspective view of a locating screw and a locating bolt.
Figure 8:
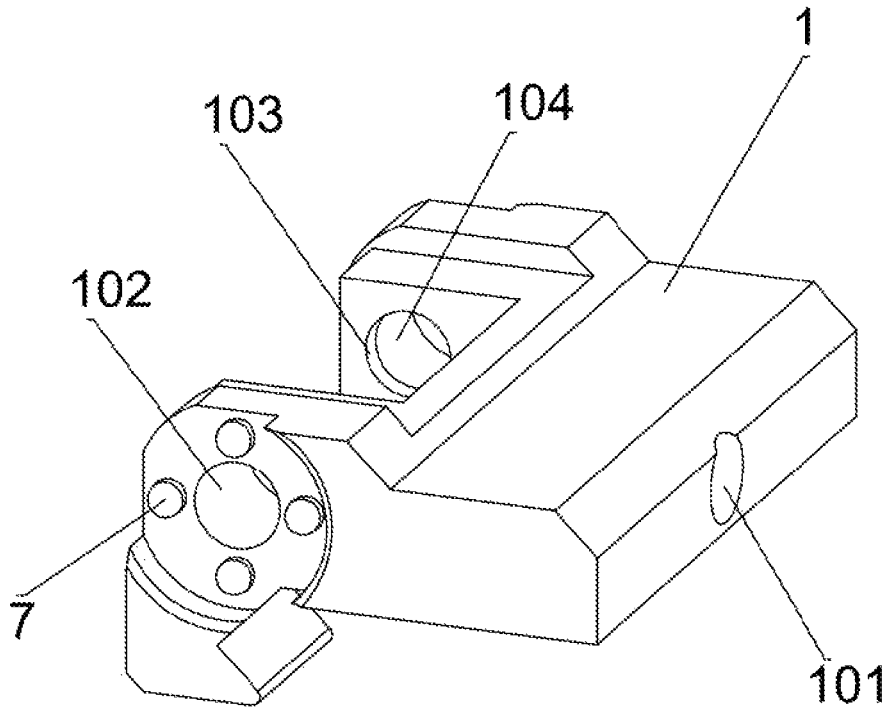
FIG. 8 is a perspective view of a main body.
Figure 9:
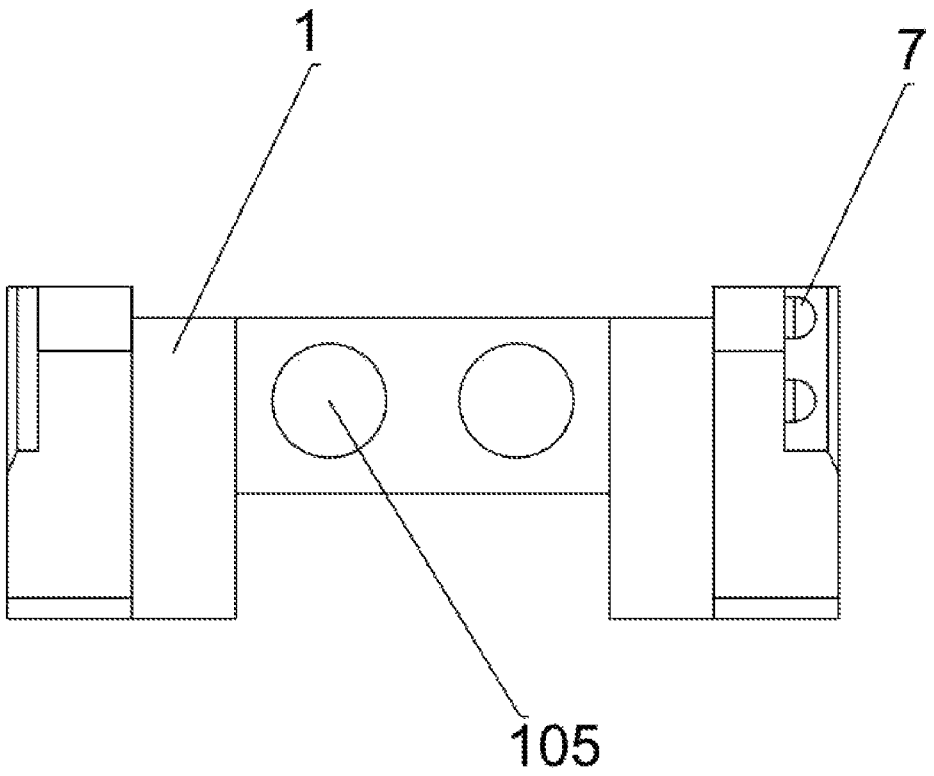
FIG. 9 is a left view of the main body.

Referring to FIG. 1 to FIG. 9, a fast overturning bracket for a gun sight, comprising: a bracket body, wherein the bracket body is composed of a main body 1 and a pressing plate 2; a connecting hole 101 is formed in a right side surface of the main body 1; the pressing plate 2 is fixed at a right side edge of the main body 1 through a pressing plate bolt 3; fixing guide rails are formed at a bottom of the main body 1 and a bottom of the pressing plate 2; the pressing plate bolt 3 is in threaded connection with the connecting hole 104; and a distance between the pressing plate 2 and the main body 1 can be controlled by rotating the pressing plate bolt 3, so that the bracket body can be fixed to guns in different sizes.

The fast overturning bracket for the gun sight further comprises an overturning rack 4; a connecting block 7 perpendicular to the overturning rack 4 is arranged at a bottom of a left side of the overturning rack 4; a groove is formed in a left side edge of the main body 1; the connecting block 401 is embedded into the groove; the connecting block 401 is connected with the main body 1 through a locating mechanism so that the overturning rack 4 can be overturned on the bracket body; the locating mechanism comprises a locating screw 5, a locating bolt 6 and four locating pins 7; the locating screw 5 is in threaded connection with the locating bolt 6; the locating pins 7 are fixed at a front end face of the main body 1; four locating grooves are uniformly formed in a screw cap of the locating screw 5 and correspond to the four locating pins 7 in position; a middle portion of the locating screw 5 is square; the locating bolt 6 comprises a first bolt column 601 and a second bolt column 602; the first bolt column 601 and the locating screw 5 have identical diameters; and the diameter of the second bolt column 602 is greater than the diameter of the first bolt column 601.

A first through hole 102, a second through hole 103 and a third through hole 104 are formed in the main body 1; a fourth through hole 402 is formed in the connecting block 401; the first through hole 102, the second through hole 103 and the fourth through hole 402 have diameters identical to the diameter of the locating screw 5, and the third through hole 104 and the second bolt column 602 have identical diameters, so that the locating mechanism can be assembled into the first through hole 102, the second through hole 103, the third through hole 104 and the fourth through hole 402; the third through hole 104 and a bottom surface of the second bolt column 602 form an elastic restoring chamber 8; a spring I 9 is arranged in the elastic restoring chamber 8, so that the four locating grooves clamp the four locating pins 7 in an embedding manner or the four locating grooves have trends to clamp the four locating pins 7 in a embedding manner; a pin hole is further formed in the connecting block 401; a pin bolt is inserted into the pin hole; through the fitting between the pin bolt and the square middle portion of the locating screw 5, the overturning rack 4 drives the locating mechanism to rotate during rotation; the four locating grooves correspond to the four locating pins 7 in position; and after the locating mechanism rotates, the locating grooves also correspond to the four locating pins 7 in position one to one, so that the overturning rack 4 can be locked at any moment.

A first fixing groove 403 and a second fixing groove 404 are formed in an outer surface of the connecting block 401 respectively, and the first fixing groove 403 and the second fixing groove 404 are located on a right side and a bottom surface of the connecting block 401 respectively; two fixing holes 105 are formed in a bottom surface of the groove; a spring II inside and a ball outside are arranged in each of the two fixing holes 105; and the two springs respectively push the balls to be clamped and embedded into the first fixing groove 403 or the second fixing groove 404 so that the overturning rack 4 can be locked at any moment.

Preferably, a plate surface of the overturning rack 4 is a straight, and a cylinder rack 10 is arranged on the overturning rack 4, the gun sight is locked in the cylinder rack 11 through the bolt, and the overturning rack 4 can be fixedly provided with devices such as a night-vision device, so that fast overturning and intermittent use of the different gun accessories are achieved; and the fast overturning bracket is wide in application scope.

Particularly, when the fast overturning bracket for the gun sight is used, the pressing plate bolt 3 is rotated firstly to release the pressing plate 2, the bracket body is buckled on a gun, the pressing plate bolt 3 is rotated so that the bracket body is fixed to the gun, then the cylinder rack 11 is fixed to the overturning rack 4, the gun sight is locked in the cylinder rack 11 through the bolt, and when devices such as the night-vision device are required, the night-vision device can be directly fixed to the overturning rack 4.

Use status I: when the gun sight is used, the spring I 9 is in relaxed status, the plate surface of the overturning rack 4 is parallel to the main body 1; the four locating grooves clamp the four locating pins 7 in an embedding manner; the spring II pushes the balls to be clamped and embedded into the first fixing groove 403; and the overturning rack 4 can't be overturned.

Use status II: when the gun sight is not required for use, the locating bolt 6 is pressed down inwards, the locating mechanism shifts inwards integrally, the four locating grooves are disconnected from the four locating pins 7, the spring I 9 is in tightly pressed status, the gun sight is pushed or pulled rightwards slightly, the overturning rack 4 is overturned by 90 degrees, the locating bolt 6 is released, under the action of elastic restoring force of the spring I 9, the locating mechanism shifts outwards integrally, the spring I 9 is in relaxed status, the surface of the overturning rack 4 is perpendicular to the main body 1, the four locating grooves clamp the four locating pins 7 in an embedding manner, the spring II pushes the balls to be clamped and embedded into the second fixing groove 404, and the overturning rack 4 can't be overturned.

Use status III: when the gun sight is used again, the locating bolt 6 is pressed down inwards, the locating mechanism shifts inwards integrally, the four locating grooves are disconnected from the four locating pins 7, the spring I 9 is in tightly pressed status, the gun sight is pushed or pulled upwards slightly, the overturning rack 4 is overturned by 90 degrees, the locating bolt 6 is released, under the action of the elastic restoring force of the spring I 9, the locating mechanism shifts outwards integrally, the spring I 9 is in the relaxed status, the plate surface of the overturning rack 4 is perpendicular to the main body 1, the four locating grooves clamp the four locating pins 7 in an embedding manner, the spring II pushes the balls to be clamped and embedded into the first fixing groove 403, and the overturning rack 4 can't be overturned.

Example 2

Figure 10:
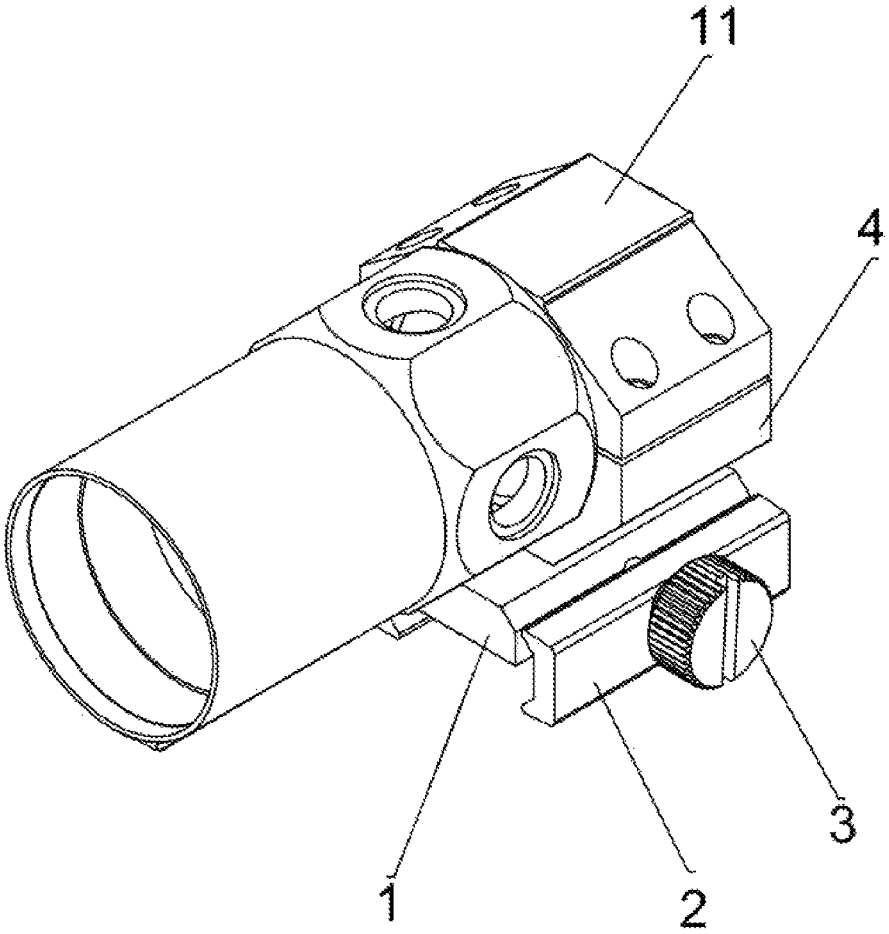
FIG. 10 is a perspective view of a gun sight of Example 2 in use.
Figure 11:
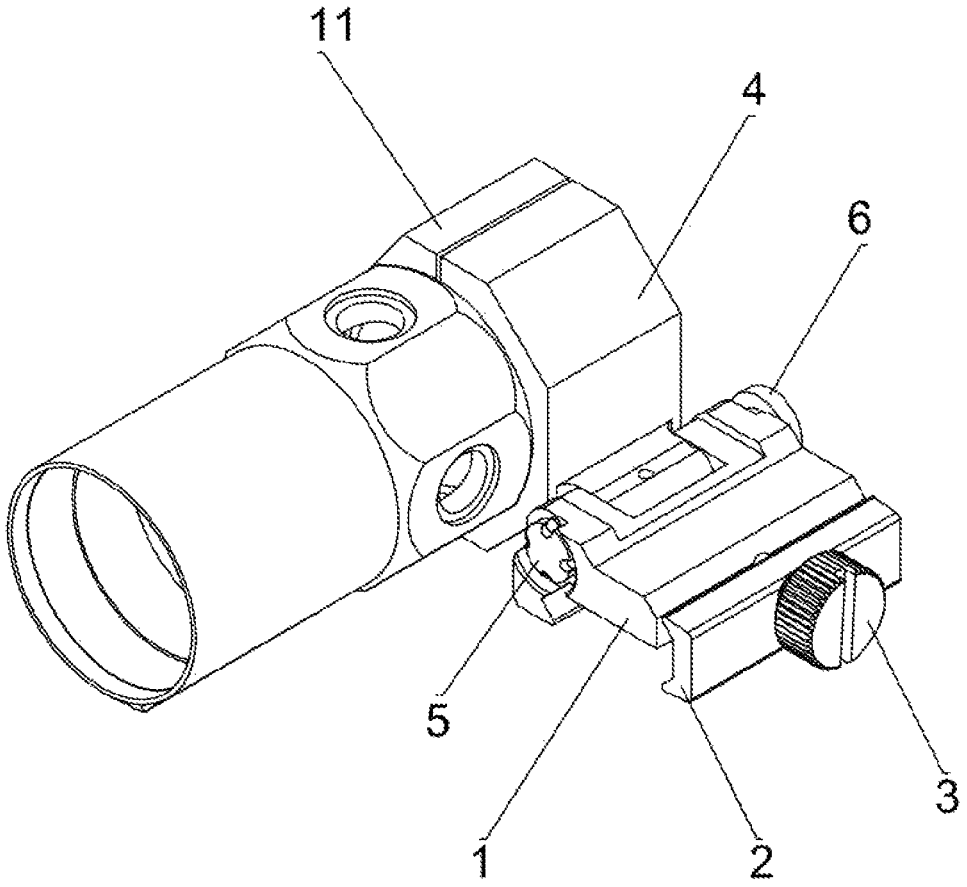
FIG. 11 is a perspective view of the overturned gun sight of Example 2.
Figure 12:
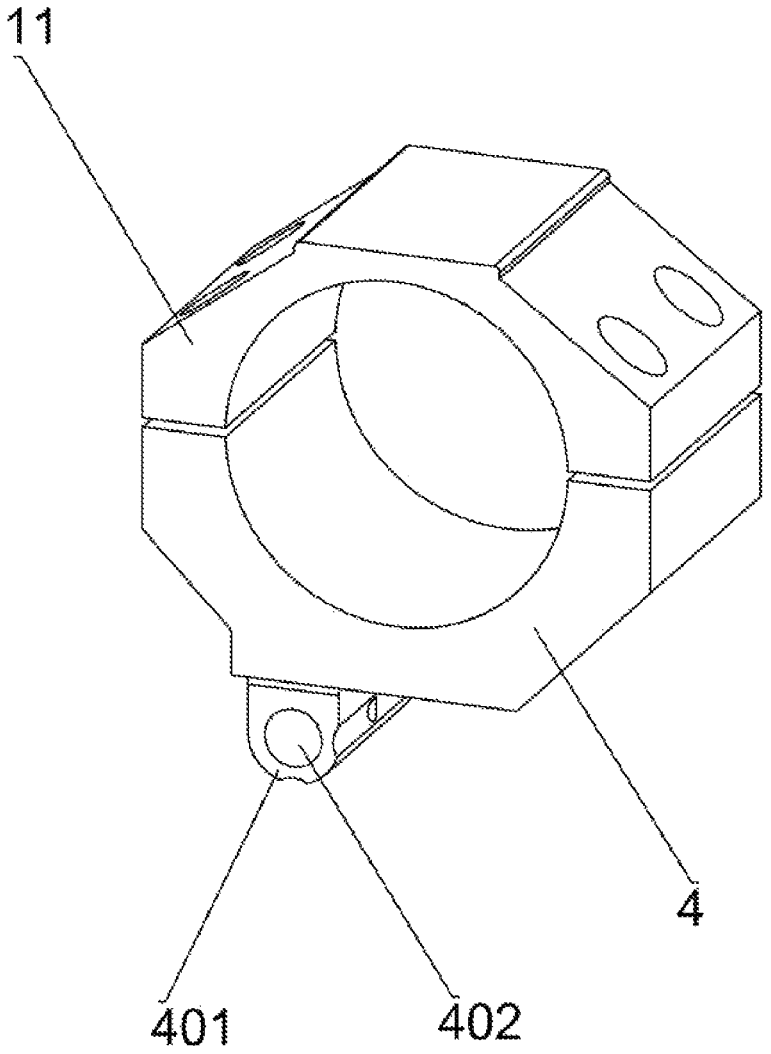
FIG. 12 is a perspective view of the overturning rack of Example 2.
Figure 13:
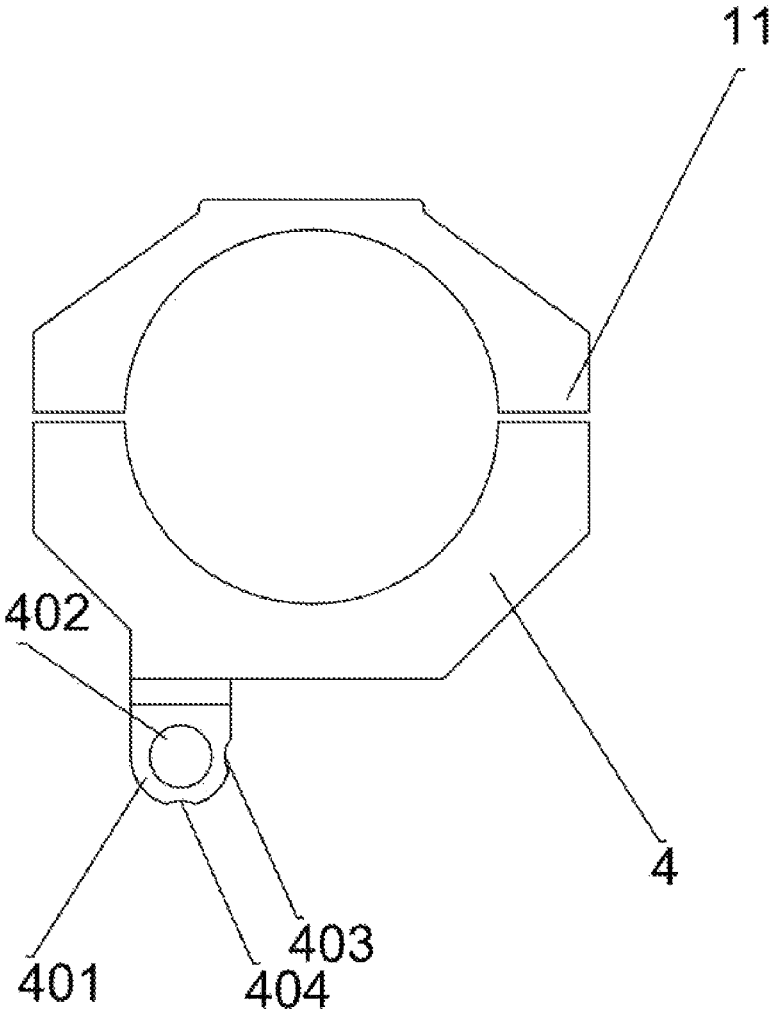
FIG. 13 is a front view of the overturning rack of Example 2.

Referring to FIG. 10 to FIG. 13, preferably, a plate surface of the overturning rack 4 is an arc-shaped plate, a semicircular rack 11 for locking the gun sight is arranged on the overturning rack 4, and a plate surface of the semicircular rack 11 is symmetrical to the plate surface of the overturning rack 4; and by fixing the semicircular rack 11 to the overturning rack 4 through the bolt for locking the gun sight, the fast overturning bracket differs from that in Example 1 in that the gun sight is directly locked by the overturning rack 4 and the semicircular rack 11, so that the guns sight in different forms can be fixed without additionally adopting external fixing devices such as a cylinder rack 10.

Certainly, the drawings above are only preferred examples of the present disclosure and are not intended to limit the application scope of the present disclosure, and therefore any equivalent changes made according to the principle of the present disclosure shall be incorporated in the protection range of the present disclosure.

The foregoing description of the exemplary embodiments of the present invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A fast overturning bracket for a gun sight, comprising:
a bracket body, wherein the bracket body is composed of a main body (1), and a pressing plate (2), and the pressing plate (2) is fixed at a right side edge of the main body (1) through a pressing plate bolt (3), and
an overturning rack (4), wherein
a connecting block (401) perpendicular to the overturning rack (4) is arranged at a bottom of a left side of the overturning rack (4);
a groove is formed in a left side edge of the main body (1);
the connecting block (401) is embedded into the groove; and
the connecting block (401) is connected with the main body (401) through a locating mechanism;
wherein two fixing holes (105) are formed in a bottom of the groove, and a spring II above and a ball below are arranged in each of the two fixing holes (105).

2. The fast overturning bracket for the gun sight of claim 1, wherein the locating mechanism comprises:
a locating screw (5);
a locating bolt (6); and
four locating pins (7), wherein the locating screw (5) is in threaded connection with the locating bolt (6); and the locating pins (7) are fixed at a front end face of the main body (1).

3. The fast overturning bracket for the gun sight of claim 2, wherein four locating grooves are uniformly formed in a screw cap of the locating screw (5) and correspond to the four locating pins (7) in position; and a middle portion of the locating screw (5) is square.

4. The fast overturning bracket for the gun sight of claim 2, wherein the locating bolt (6) comprises a first bolt column (601) and a second bolt column (602), and the first bolt column (601) and the locating screw (5) have identical diameters.

5. The fast overturning bracket for the gun sight of claim 4, wherein
a first through hole (102), a second through hole (103) and a third through hole (104) are formed in the main body (1);
a fourth through hole (402) is formed in the connecting block (401);
the first through hole (102), the second through hole (103) and the fourth through hole (402) have diameters identical to the diameter of the locating screw (5); and
the third through hole (104) and the second bolt column (602) have identical diameters.

6. The fast overturning bracket for the gun sight of claim 5, wherein the third through hole (104) and a bottom surface of the second bolt column (602) form an elastic restoring chamber (8), and a spring I (9) is arranged in the elastic restoring chamber (8).

7. The fast overturning bracket for the gun sight of claim 5, wherein a first fixing groove (403) and a second fixing groove (404) are formed in an outer surface of the connecting block (401), respectively, and the first fixing groove (403) and the second fixing groove (404) are located on a right side and a bottom surface of the connecting block (401), respectively.

8. The fast overturning bracket for the gun sight of claim 1, wherein a plate surface of the overturning rack (4) is a straight plate, and a cylinder rack (10) for locking the gun sight is arranged on the overturning rack (4).

9. The fast overturning bracket for the gun sight of claim 8, wherein the plate surface of the overturning rack (4) is an arc-shaped plate, a semicircular rack (11) for locking the gun sight is arranged on the overturning rack (4), and the plate surface of the semicircular rack (11) is symmetrical to the plate surface of the overturning rack (4).

* * * * *